US012790809B1

(12) United States Patent
Assif et al.

(10) Patent No.: US 12,790,809 B1
(45) Date of Patent: Nov. 10, 2026

(54) MODULAR BUILDING AND METHOD OF ERECTING SAID MODULAR BUILDING

(71) Applicant: Moducan Corporation, Rancho Mirage, CA (US)

(72) Inventors: Guy Assif, Rancho Mirage, CA (US); Adam Yousfi, Warsaw (PL)

(73) Assignee: MODUCAN CORPORATION, Rancho Mirage, CA (US)

( * ) Notice: Subject to any disclaimer, the term of this patent is extended or adjusted under 35 U.S.C. 154(b) by 162 days.

(21) Appl. No.: 18/769,045

(22) Filed: Jul. 10, 2024

Related U.S. Application Data

(60) Provisional application No. 63/526,063, filed on Jul. 11, 2023.

(51) Int. Cl.
*E04B 1/24* (2006.01)

(52) U.S. Cl.
CPC .... *E04B 1/2403* (2013.01); *E04B 2001/2406* (2013.01); *E04B 2001/2415* (2013.01)

(58) Field of Classification Search
CPC .... E04B 1/1903; E04B 1/1906; E04B 1/1909; E04B 1/1912; E04B 1/2403; E04B 2001/1915; E04B 2001/1918; E04B 2001/1921; E04B 2001/193; E04B 2001/1936; E04B 2001/1957; E04B 2001/196; E04B 2001/1963; E04B 2001/1966; E04B 2001/1984; E04B 2001/2406; E04B 2001/1436; E04B 2001/2415; E04B 2001/2418; E04B 2001/2421; E04B 2001/2457; E04H 15/34; E04H 15/54; E04H 15/64; E04H 15/642; E04H 15/646; E04H 15/648
See application file for complete search history.

(56) References Cited

U.S. PATENT DOCUMENTS

| | | | | |
|---|---|---|---|---|
| 3,362,739 | A | 1/1968 | Staeger et al. | |
| 4,470,647 | A | 9/1984 | Bishoff et al. | |
| 6,014,842 | A | 1/2000 | Matsubara | |
| 6,609,336 | B2 | 8/2003 | Matsubara | |
| 2012/0000874 | A1* | 1/2012 | Calleja | E04B 1/24 211/182 |
| 2015/0017377 | A1 | 1/2015 | Graham et al. | |

(Continued)

*Primary Examiner* — Brian D Mattei
*Assistant Examiner* — Audrey Fisher
(74) *Attorney, Agent, or Firm* — Invention To Patent Services; Alex Hobson

(57) ABSTRACT

A modular building incorporates a corner connector cube configured to connect to edge beams that extend along the corners of walls, which includes along the edge of the ceiling and floor and has interchangeable interconnect surfaces. The edge beams terminate with beam interconnect surfaces having beam end attachment apertures that align with the cube end attachment apertures of the corner connector cube, to receive a fastener therethrough to detachably attach an edge beam to a corner connector cube. The edge beams have a beam wall slot between beam extensions to receive a wall panel therein. Also, the corner connector cube has a wall slot to enable a wall panel to slide into the corner connector cube to further reinforce and strengthen the modular building. Stud beams are configured to extend between edge beams to provide support for walls including the ceiling and floor.

25 Claims, 22 Drawing Sheets

(56) References Cited

U.S. PATENT DOCUMENTS

| | | | | |
|---|---|---|---|---|
| 2015/0377414 | A1* | 12/2015 | Pirseyedi | F16B 7/0466 403/205 |
| 2016/0129975 | A1* | 5/2016 | Craig | E04H 15/18 135/124 |
| 2017/0022726 | A1* | 1/2017 | Sun | E04B 1/2403 |
| 2018/0094419 | A1* | 4/2018 | Houghton | E04B 1/1903 |
| 2018/0135295 | A1 | 5/2018 | Bowron | |
| 2019/0257070 | A1* | 8/2019 | Grosch | E04B 1/5831 |
| 2022/0098852 | A1* | 3/2022 | Wiedebush | E04B 1/5831 |
| 2022/0186487 | A1 | 6/2022 | Bowron | |
| 2022/0195714 | A1* | 6/2022 | Chagnon | E04B 1/34305 |
| 2022/0243453 | A1 | 8/2022 | Bowron | |
| 2023/0026166 | A1* | 1/2023 | Lynn Brouwers | E04H 15/44 |
| 2023/0125829 | A1* | 4/2023 | Parkhouse | E04B 1/3483 52/79.13 |

* cited by examiner

MODULAR BUILDING AND METHOD OF ERECTING SAID MODULAR BUILDING

CROSS REFERENCE TO RELATED APPLICATIONS

This application claims the benefit of priority to U.S. provisional patent application No. 63/526,063, filed on Jul. 11, 2023; the entirety of which is hereby incorporated by reference herein.

FIELD OF THE INVENTION

The invention relates to modular buildings and methods of erecting said modular building.

BACKGROUND OF THE INVENTION

Background

With climate change and weather related events increasingly taking their toll on communities around the globe, and with the vast resources and costs spent to aid and assist communities in need of safe and reliable shelters, coupled with loss and deteriorating quality of life and worsening environmental effects stemming from the waste created in the process of disposing these temporary solutions once the disaster ends (for example: the trailers used by FEMA), these actions then contribute even more to climate change, causes the cycle to repeat and grow from year to year.

With military conflicts and growing security threats around the globe, both aid agencies (such as USAID) and military forces deploy personnel, equipment, and supplies, often at very short notice and to hazardous zones.

Current temporary shelter solutions regularly involve the use of tents and containers which are both cumbersome to deploy and install, restricted by a pre-determined design, and often lack in comfort and important safety features.

SUMMARY OF THE INVENTION

The invention is directed to modular buildings and methods of erecting said modular building. An exemplary modular building incorporates a corner connector cube configured to connect to edge beams that extend along the corners of walls, which includes along the edge of the ceiling and floor. The corner connector cube has interchangeable interconnect surfaces, wherein the corner connector cube can be rotated or flip to connect any one of the six interconnect surfaces to an edge beam. A corner connector cube is configured to have six edge beams connected. In a conventional corner a corner connector cube may have three edge beams connected that extend two in a plane and one orthogonal to these planar extensions. A corner connector cube configured between modular bays of a modular building may have four edge beams connected and if the modular building is multi-level, five edge beams may be connected to the corner connector cube. A centrally located corner connector cube within a multi-level modular building may have six edge beams connected to each of the cube surfaces. The edge beams terminate with beam interconnect surfaces having beam end attachment apertures that align with the cube end attachment apertures of the corner connector cube, to receive a fastener therethrough to detachably attach an edge beam to a corner connector cube. The edge beams have a beam wall slot between beam extensions to receive a wall panel therein. This slot engages with the wall panel to provide additional support and retention of the wall panel between the edge beams. Also, the corner connector cube has a wall slot to enable a wall panel to slide into the corner connector cube to further reinforce and strengthen the modular building.

A modular bay is a space defined by singular extensions of edge beams in orthogonal directions to define a rectangular volume. A plurality of modular bays may be coupled together to form a larger open volume within the modular building.

Stud beams are configured to extend between edge beams to provide support for walls including the ceiling and floor. The stud beams have stud attachment brackets on the opposing end of the stud beam extension. The stud attachment brackets have stud attachment bracket apertures to receive a fastener therethrough and into beam extension attachment apertures of the edge beam. The beam extension attachment apertures may be threaded and may include a threaded rivet therein to enable a fastener to be inserted through the stud attachment bracket apertures and then threaded into the beam extension attachment apertures of the edge beam to secure the stud beam to the edge beam. Likewise, the stud beam may have a plurality of stud depth extension attachment apertures configured along the depth surface of the stud extension for attachment of cross-beams, or truss beams that may be used to support and frame a window or door or the attachment of accessories, such as shelves, closet and closet features such as hanger rods, etc. The stud beam also has stud width extension attachment apertures configured on the width surface that may be used to fasten accessories of fasten a wall panel thereto.

A stud beam may be configured with dimensions to provide effective support of a wall and support the weight of an edge beam and roof or ceiling components. A stud width extends along the length of an edge beam when a modular building is erected with stud beams configured between edge beams in a wall of the modular building and a stud depth extend across the length of the edge beam. A stud width may be less than a stud depth and may be a fraction of the stud depth, such as about 0.9 or less, about 0.75 or less, about 0.5 or less, about 0.35 or less the stud depth and any range between and including the ratios provided.

A truss beam may be configured between stud beams to provide additional support for a wall, floor or ceiling of the modular building. The truss beam has truss beam brackets on either end of the truss beam with truss beam bracket apertures for receiving a fastener therethrough. A truss beam may be secured to the stud surface to brace the stud beam along the stud beam extension. A truss beam may be an integral truss beam that extends from a first support, such as a first edge beam, to a second support, such as a second edge beam. The integral truss beam has stud beam receivers having stud beam channel to receive the stub beam therein and stub beam retainers, such as bolts, that can be turned to secure the stud beam in the stud beam channel. An integral truss beam may have a plurality of stud beam receivers and these stud beam receivers may be positioned a pre-defined distance from each other for proper alignment with the stud beams. An integral truss beam may be quicker to assemble and may provide improved wall support over individual truss beams between adjacent stud beams.

An accessory beam may be configured between stud beams to provide additional support for a wall, floor or ceiling of the modular building but more particularly to provide a framing for a door or a window. The accessory beam has accessory beam brackets on either end of the accessory beam with accessory beam bracket apertures for receiving a fastener therethrough. An accessory beam may be secured to the stud dept surface to brace the stud beam along the stud beam extension and frame out a door or window. The accessory beam brackets have accessory bracket slots to allow the bracket to slide along the stud beam and over any threaded rivets or fastener heads in the stud beam extension.

A corner connector cube is configured to enable versatility during assembly, wherein each of the cube interconnect surfaces has a cube wall slot 56 that enables a fastener to be inserted into the interior of the corner connector cube for fastening into an edge beam. Also, each cube interconnect surface has a cube center aperture that may also be used for inserting a fastener therethrough. A cube center sleeve may be configured to extend within the interior of the corner connector cube to provide additional strength and support. An exemplary cube center sleeve extends from one cube interconnect panel along the interior of the corner connector cube to an opposing cube interconnect panel. A corner connector cube may be oriented with the cube center sleeve extending vertically to provide compression strength of the corner connector cube, in particular when the corner connector cube is configured in a base or floor corner and an edge beam extends vertically upward from said corner connector cube. A The cube center sleeve is configured to align with the two cube center apertures on these two connected cube interconnect panels. The continuous sleeve through the corner connector cube is configured to receive the base extension of a base foot assembly. Therefore, the cube center sleeve is configured for orientation vertically along the base of the modular building when a base foot assembly is used for supporting the modular building or leveling the modular building on an uneven ground surface. Also, the cube center sleeve and cube center apertures on either end of the cube center sleeve are configured to align with the beam center aperture to enable the base extension to extend not only into the corner connector cube but also up into an edge beam that extends vertically. This arrangement enables greater extension of the base extension into and out of the modular building.

In an exemplary embodiment, the base foot assembly is used to support a modular building on an uneven ground surface wherein the base foot is retained at an offset position from the corner connector cube by one or more spacers. The spacers are configured with a spacer slot to allow the spacer to slide around the base extension to raise the modular building from a ground surface.

An exemplary modular building system may utilize a corner retainer for retaining a corner connector cube to an end of an edge beam during attachment. The corner retain has corner retainer apertures configured to align with apertures in the edge beam to secure the corner retainer to the edge beam with fasteners. The corner retainer has an extension from the attached portion to a corner retainer catch, an orthogonal portion from the corner retainer extension. A gap between the end of the edge beam and the corner retainer catch is configured to receive a corner interconnect panel therein. This arrangement retains the corner cube in an aligned configuration with the edge beam such that the beam end attachment apertures align with the cube end attachment apertures.

A roof accessory beam assembly may be configured to attach to the modular building, such as to the corner connector cube and extend out from the modular building. The roof beam extension may extend out past the perimeter of the modular building defined by the edge beams and may have a roof beam clamp coupled to this roof beam extension that is configured to retain a roofing material, such as a tarp which may be camouflaged and may extend over a roof or ceiling comprising roof panels therein. Also, the roofing material or tarp that extends out from the perimeter of the modular building provides an awning around the perimeter.

A wall panel may be further supported and strengthened by a support cable that is coupled across a wall, ceiling or floor by support cable attachment brackets that are coupled to an edge beam or stud beam, for example. The support cable may be tensioned by a support cable tensioner to produce tension in the cable.

A modular building may be configured to receive any suitable type of wall panel, from drywall or gypsum board, to metal panels for additional security and protection to composite panels having a plurality of layers. An exemplary wall panel may include a magnesium oxide panel which provides fire and water protection. A magnesium oxide panel may be coupled with a foam layer. In an exemplary embodiment a foam layer is configured between two other layers, such as one of more of a magnesium oxide panel, metal panel, wood panel, plastic panel or gypsum board. A pair of magnesium oxide panels may be configured on either side of a foam layer or foam panel. Other wall panels may include structural elements for blast protection and may include reinforcing elements, such as wire or beams within or coupled with the wall panel.

A modular building is configured to house people and therefore the length of an edge beam or may be about 2 m or more, 2.5 m or more, 3 m or more and any range between and including the values provided. If the edge beams are too long, they may be difficult to maneuver for quick and manual assembly of the modular building. Also, the corner connector cube may have a dimension (length or width of a cube interconnect surface) of about 100 mm or more, about 150 mm or more, about 200 mm or more, about 250 mm or more and any range between and including the cube dimensions provided.

The proposed modular system is designed to provide government agencies appropriate, indestructible, and reusable solutions whenever there is the need for quick, consistent, reliable and safe temporary shelter to both first responders deployed to the affected zones as well as to the communities who require temporary housing up until their homes are fully rebuilt.

The proposed system, under certain circumstances, and with appropriate floor components and flexible utility supplies, will enable floatable structures if and when the set up is required in flood prone zones.

The proposed modular system is designed to support such missions by providing mission-appropriate, safe and secure temporary habitable environments, versatile and interchangeable in terms of size and design, which will protect both the troops and its equipment from a variety of threats and extreme weather conditions which may be encountered by the troops while deployed.

The modular nature of the system allows the implementation of cladding components which will enable various levels of defense, depending on the threats identified and the specific mission it will be required to support.

A modular building may be configured to move vertically as water levels rise to prevent flooding of the modular building. A bladder or bladder may be configured between the ground surface and the floor of the modular building to force the modular building up along the base foot extensions as the water levels rise. Also, a modular building system may be configured to receive utilities such as electrical power and plumbing including water supply and drains for water and sewage. These utilities may be configured to move with the modular building as it is elevated or lowered due to an increasing water level.

Definitions

A corner connector cube is defined herein as being a cube in shape with six surfaces that are orthogonal to each other along connecting edges and wherein the cross section of the corner connector cube is rectangular when taken parallel with one of the six cube interconnect surfaces. An exemplary corner connector cube has six sides with substantially the same size, or within about 5% of each other in a length and width dimension. A corner connector cube may be rectangular in shape with each of the opposing sides having substantially the same size, as defined herein.

The summary of the invention is provided as a general introduction to some of the embodiments of the invention, and is not intended to be limiting. Additional example embodiments including variations and alternative configurations of the invention are provided herein.

BRIEF DESCRIPTION OF SEVERAL VIEWS OF THE DRAWINGS

The accompanying drawings are included to provide a further understanding of the invention and are incorporated in and constitute a part of this specification, illustrate embodiments of the invention, and together with the description serve to explain the principles of the invention.

Figure 1:
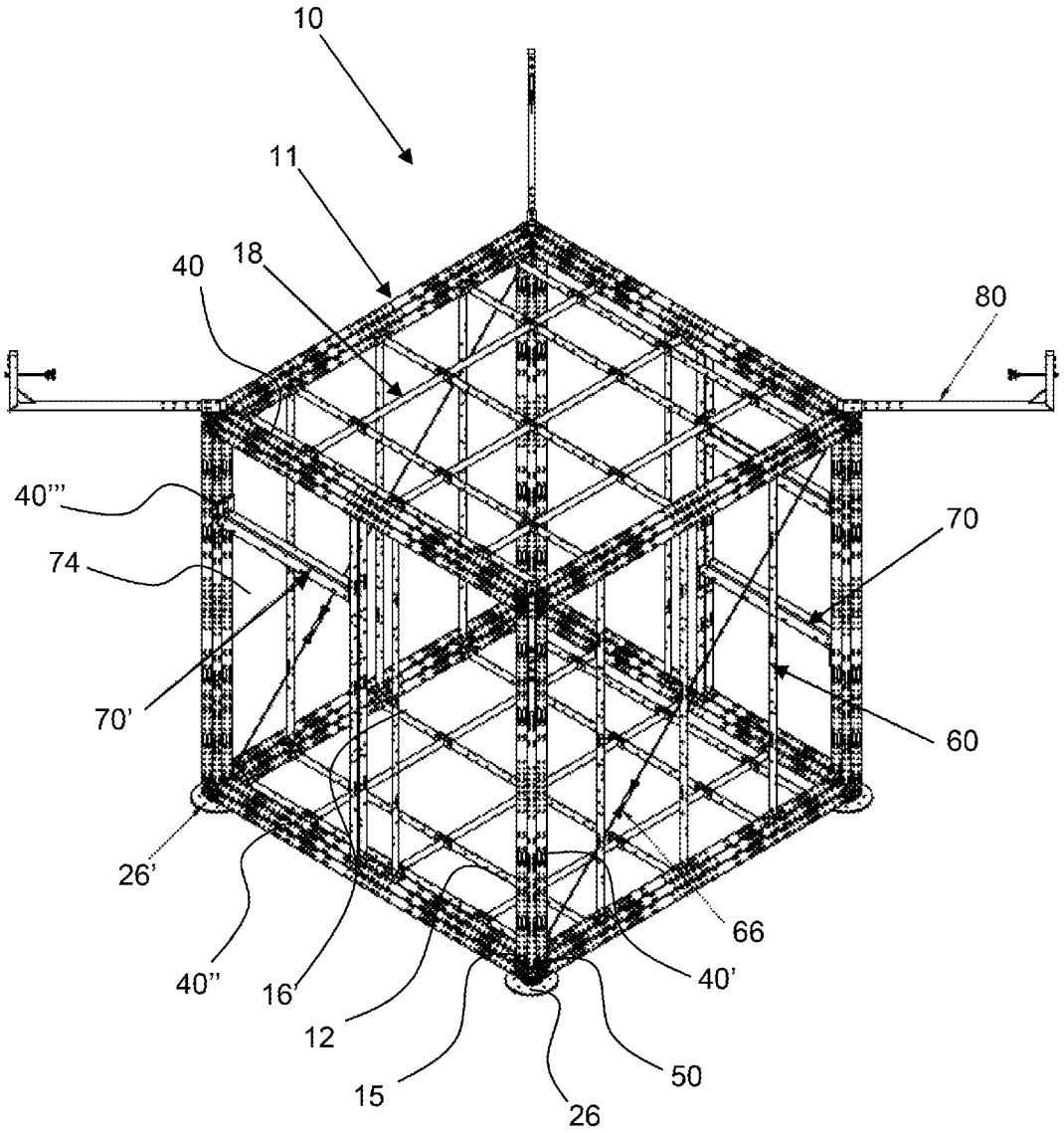
FIG. 1 shows a perspective view of a modular building that is a single modular bay having twelve edge beams connected at corners of the modular building by respective eight corner connector cubes.

Corresponding reference characters indicate corresponding parts throughout the several views of the figures. The figures represent an illustration of some of the embodiments of the present invention and are not to be construed as limiting the scope of the invention in any manner. Some of the figures may not show all the features and components of the invention for ease of illustration, but it is to be understood that where possible, features and components from one figure may be an included in the other figures. Further, the figures are not necessarily to scale, some features may be exaggerated to show details of particular components.

Therefore, specific structural and functional details disclosed herein are not to be interpreted as limiting, but merely as a representative basis for teaching one skilled in the art to variously employ the present invention.

DETAILED DESCRIPTION OF THE ILLUSTRATED EMBODIMENTS

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Also, use of "a" or "an" are employed to describe elements and components described herein. This is done merely for convenience and to give a general sense of the scope of the invention. This description should be read to include one or at least one and the singular also includes the plural unless it is obvious that it is meant otherwise.

Certain exemplary embodiments of the present invention are described herein and are illustrated in the accompanying figures. The embodiments described are only for purposes of illustrating the present invention and should not be interpreted as limiting the scope of the invention. Other embodiments of the invention, and certain modifications, combinations and improvements of the described embodiments, will occur to those skilled in the art and all such alternate embodiments, combinations, modifications, improvements are within the scope of the present invention.

Figure 2:
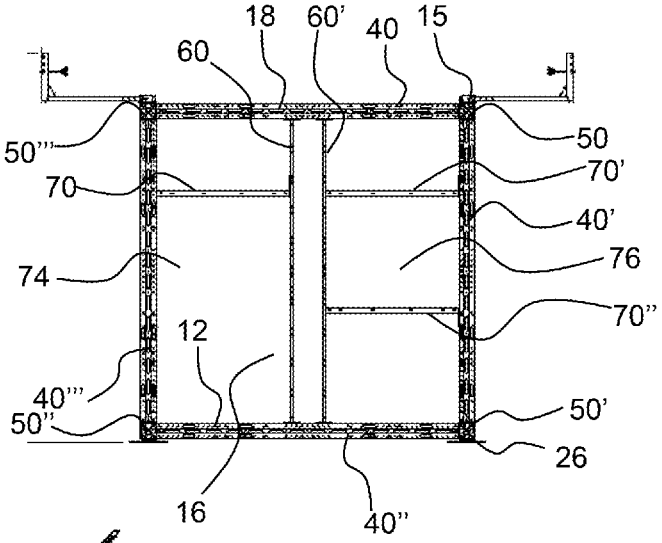
FIG. 2 shows a side view of a modular building having accessory beams to form a door opening and a window opening.

Referring to FIGS. 1 to 4, an exemplary modular building 10 is single modular bay 11 having twelve edge beams 40 connected at corners 15 of the modular building by respective eight corner connector cubes 50. As shown in FIG. 1, the edge beams 40, 40', 40" and 40", configured around wall 16 are all the same length, as are all the edge beams in this single modular bay 11. The modular bay therefore is cube shaped, having walls 16, ceiling 18 and floor 12 that are all the same size. The walls have stud beams 60 extending vertically from a lower edge beam to an upper edge beam, extending along the ceiling of the modular building. Support cables extend across the some of the walls and through apertures in the stud beams 60 to reinforce the modular building. Accessory beams 70 form a door opening 74 and accessory beams 70', 70" form a window opening 76, as shown in FIG. 2. Base foot assemblies 26, 26' are configured on each of the corners and enables the modular building 10 to be raised up from a ground surface. A roof accessory beam assembly 80 is coupled to each of the ceiling corners and extends out from the walls of the modular building.

As shown in FIG. 2, the wall 16 has a pair of stud beams 60, 60' and accessory beams 70, 70', 70" to form a door opening 74 and window opening 76. The wall is framed by four edge beams 40, 40', 40" and 40" connected at the corners 15 by corner connector cubes 50, 50', 50" and 50".

Figure 3:
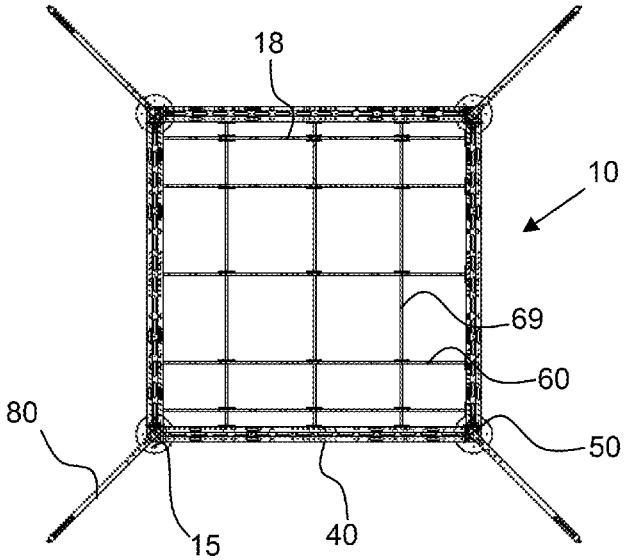
FIG. 3 shows a top view of a modular building having stud beams and bracing beams configured between the stud beams for additional support of a roof structure.

As shown in FIG. 3, the modular building 10 has stud beams 60 extending across the ceiling 18 for support and truss beams 69 configured between the stud beams for additional structural support. Roof accessory beam assemblies 80 are coupled to each of the corners for of the ceiling 18 of the modular building and extend out from the walls.

Figure 4:
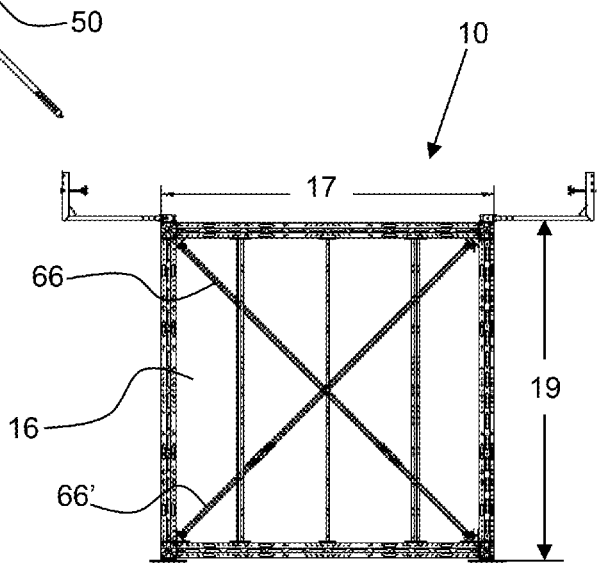
FIG. 4 shows a side view of a modular building having stud beams and support cables to provide additional structural support.

As shown in FIG. 4, an exemplary wall 16 of a modular building 10 has support cables 66, 66' extending in a crisscross geometry across the wall 16 to produce an X-brace that further supports the wall. The wall has a width 17 and a height 19 that are the substantially equal, or withing about 10% of each other and preferably within 5% of each other.

Figure 5:
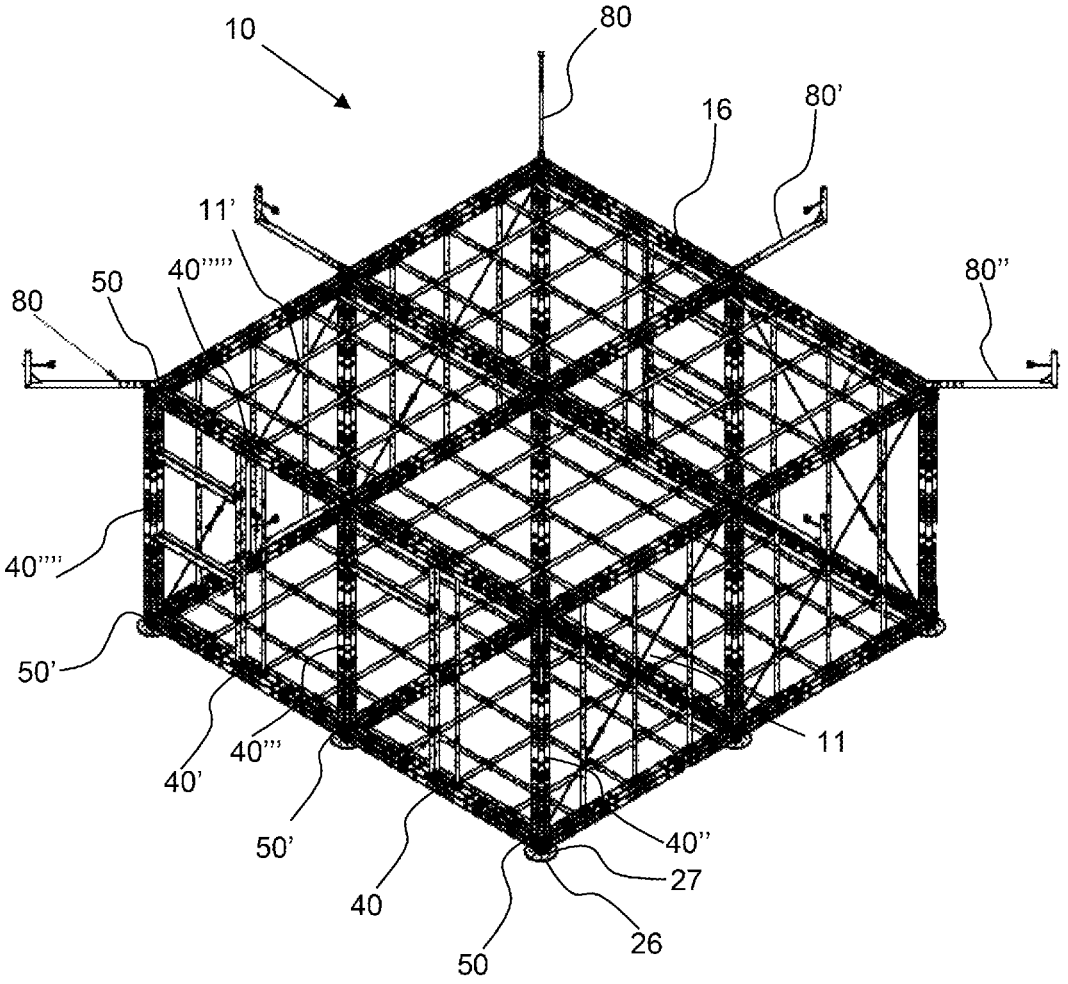
FIG. 5 shows a perspective view of a modular building that comprises components of a plurality of modular bays to form a larger modular building.
Figure 6:
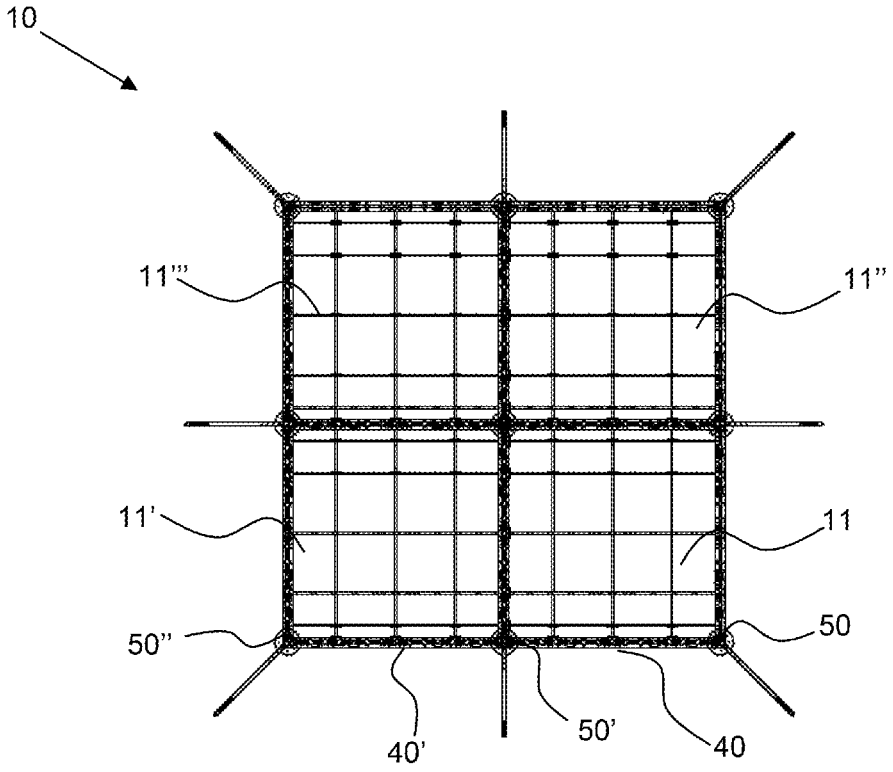
FIG. 6 shows a top view of the modular building shown in FIG. 5.
Figure 7:
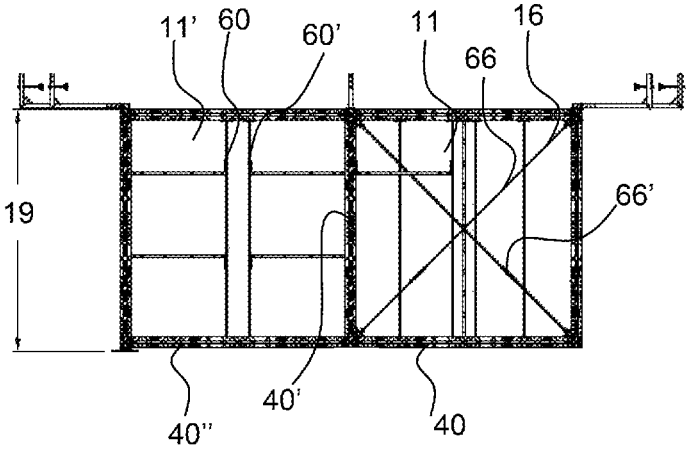
FIG. 7 shows a side view of a modular building that comprises components of a plurality of modular bays to form a larger modular building

Referring now to FIGS. 5 to 7, an exemplary modular building 10 comprises components of a plurality of modular bays 11, 11' to form a larger modular building. The wall 16 of the modular building has a first edge beam 40 extend along and edge of the floor and a second edge beam 40' further extending along the edge of the floor with a corner connector cube 50' between them. The wall also has a center edge beam that extends vertically up from corner connector cube 50' to further support the wall. This modular building has walls that are twice as long but the same height as the modular building shown in FIG. 1. As shown in FIG. 6, this larger modular building includes components of four modular bays 11, 11', 11", and 11". As shown in FIG. 5, roof accessory beam assemblies, 80, 80" are coupled to the corner connector cubes at the ends or corner of the wall 16 and roof accessory beam assembly 80' is coupled to a corner connector cube along the length of the wall. The roof beam extension 84 of the roof accessory beam assembly 80' extends out orthogonally from the length of the wall and roof accessory beam assemblies, 80, 80" extend out at an offset angle, such as 45 degrees from the wall. A roofing cover material, such as a tarp may be coupled to the roof accessory beam assembly and extend over the roof of the modular building. A roofing cover material may provide additional protection for the building, such as preventing drones or other projectiles from detonating on the roof of the building. A roofing cover material may cause an explosive projectile to detonate on impact with the roofing cover material versus on contact with the roof. This offset distance from the roof may prevent damage and loss of life from the attack.

As shown in FIG. 7, the wall 16 of a larger modular building 10 has an edge beam 40' extending vertically along the wall between edge beams 40, 40" that extend horizontally. Also, the wall shown in FIG. 7 has different features between the first wall portion, configured on one side of the middle edge beam 40 and the second wall portion, configured on the other side of the middle edge beam 40. The first wall portion has a pair of stud beam 60, 60' and accessory beams 69 extending horizontally from the stud beams and the vertical edge beams. The second wall portion has support cables 66, 66' extending diagonally across the wall to reinforce the wall.

Figure 8:
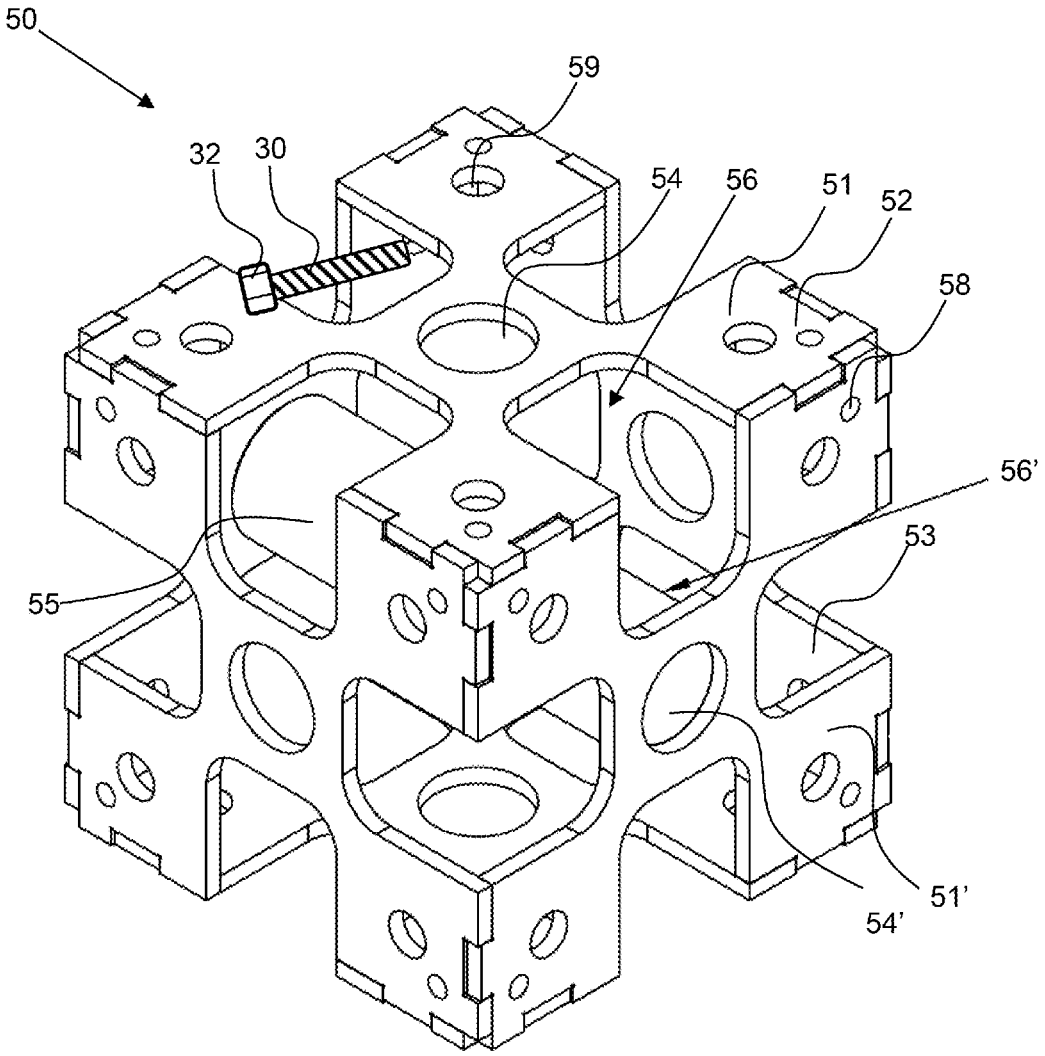
FIG. 8 shows a perspective view of an exemplary corner connector cube having six cube interconnect surfaces configured in a cube shape and a center aperture in each of the six cube interconnect surfaces and cube end attachment apertures.
Figure 9:
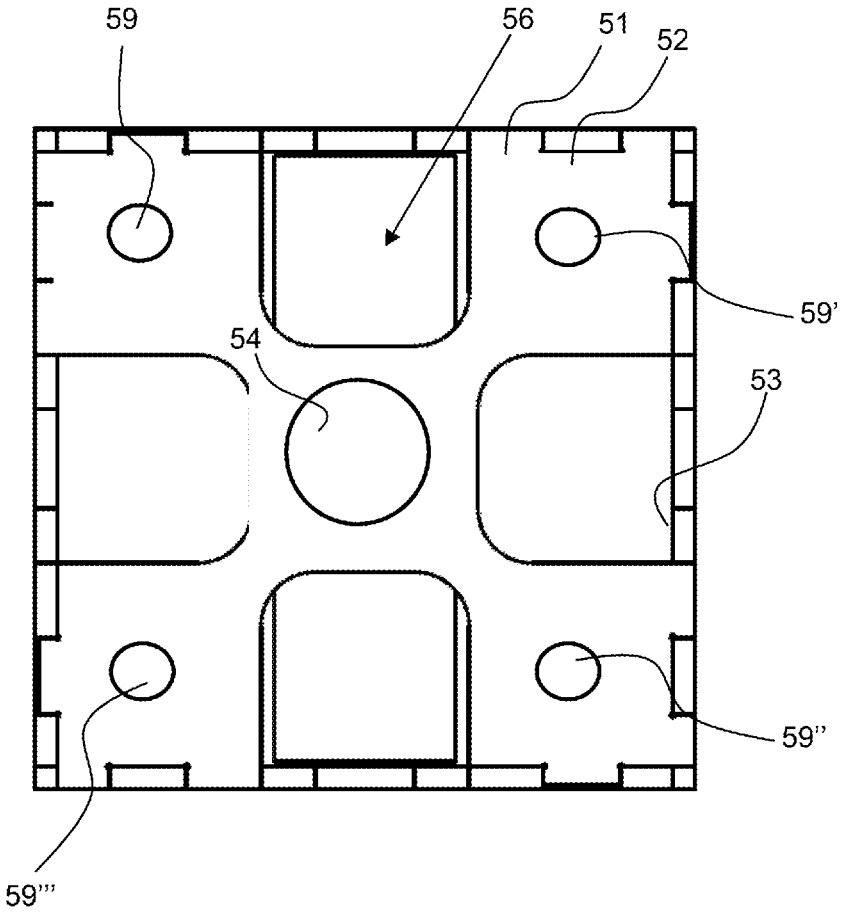
FIG. 9 shows a side view of the exemplary corner connector cube shown in FIG. 8 having cube wall slots extending in from each edge of the cube interconnect panels toward the center of the side of the corner connector cube, and between cube end attachment apertures.
Figure 10:
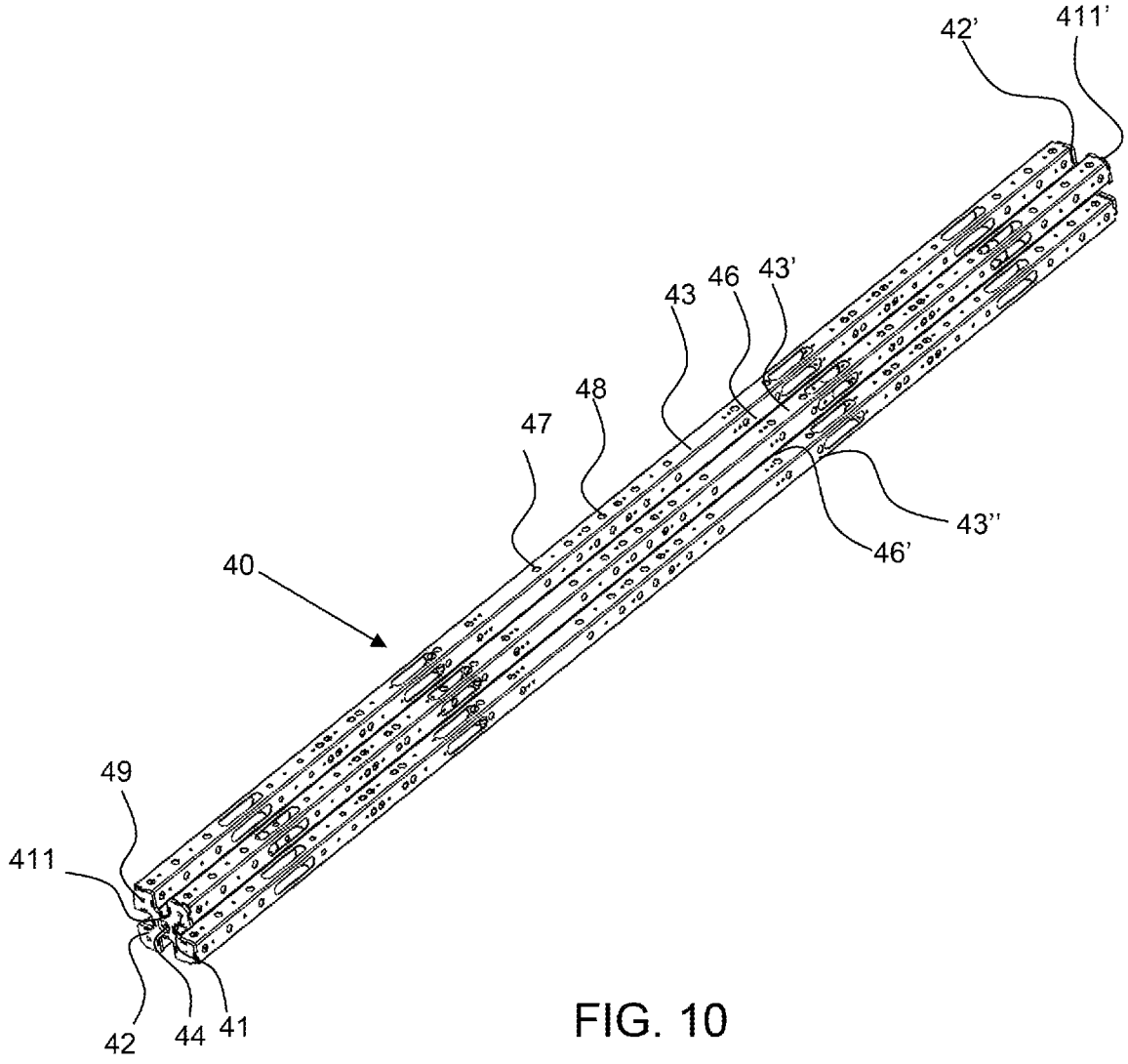
FIG. 10 shows an exemplary edge beam having a beam interconnect surface on each of the beam ends, beam extension attachment apertures configured along the edge beam and a beam wall slot configured between beam extensions of the edge beam.
Figure 11:
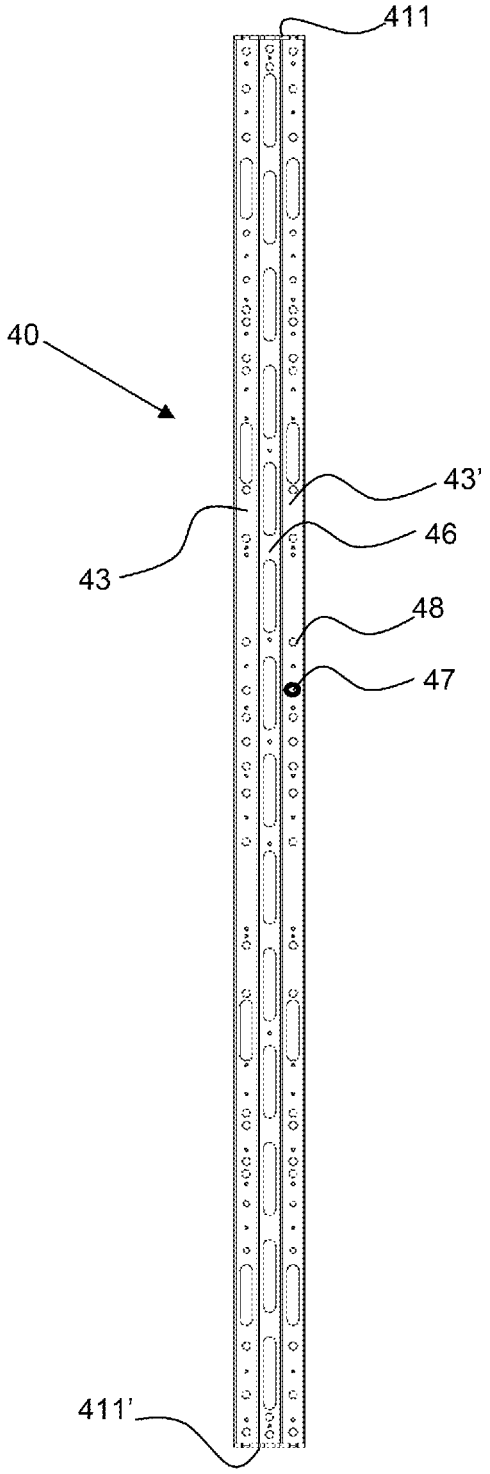
FIG. 11 shows a side view of the exemplary edge beam shown in FIG. 10.

Referring now to FIGS. 8 and 9, an exemplary corner connector cube 50 has six cube interconnect surfaces 52 configured in a cube shape and a center aperture 54, 54' in each of the six cube interconnect surfaces and cube end attachment apertures 59. A fastener 30 is configured to be inserted from an interior of the corner connector cube through a cube end attachment aperture and into an aperture in an interface end of an edge beam to secure the corner connector cube to the edge beam. The fastener head 32 is larger than the cube end aperture to secure the corner connector cube to an edge beam. The corner connector cube may include cube interconnect panels 51 the are planar panels that form the sides and cube interconnect surfaces. A cube center sleeve 55 may extend across the interior of the corner connector cube 50 and be configured to receive an extension for an accessory or for the base foot assembly. Each face or side of the corner connector cube 50 has cube wall slots 56, 56' extending in from each edge of the cube interconnect panels 51 toward the center of the side of the corner connector cube, and between cube end attachment apertures. The cube wall slots may have cube wall slot surfaces 53. These slots may be configured to receive a wall panel therein to further support and reinforce the modular building. As shown in FIG. 8, each of the cube interconnect surfaces 52, has a plurality of cover-plate pin holes 58 for receiving pins extending from a cover plate (not shown). The cover plate may be a planar plate that prevents water and debris from getting into the corner cube. The corner connector cube 50 may be rectangular or cube shaped and have orthogonal cube interconnect surfaces 52 extending from the edge of each wall.

The corner connector cube shown in FIGS. 8 and 9 has six cube interconnect surfaces with substantially the same size, wherein the length and width dimensions of each side are within about 5% of each other.

Figure 12:
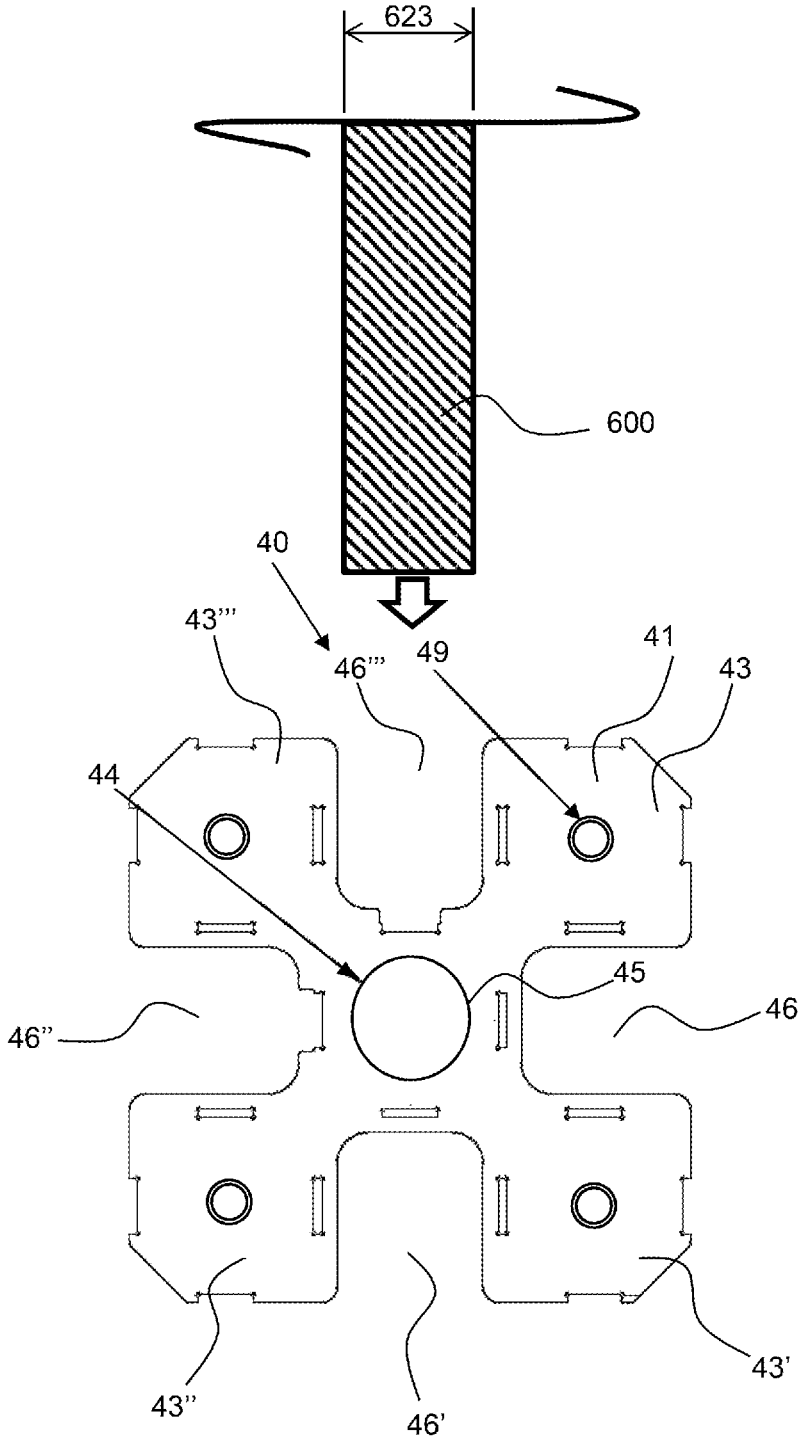
FIG. 12 shows a beam end view of an exemplary edge beam and the beam interconnect surface having beam end attachment apertures for coupling the edge beam with a corner connector cube.

Referring now to FIGS. 10 to 13, an exemplary edge beam 40 extends a length from a first beam end 411 to a second beam end 411' and has a beam interconnect surface 42, 42' on each of the beam ends. The interconnect surfaces are configured to connect to the corner connector cubes and may include a beam interconnect panel 41. Beam end attachment apertures 49 may be configured to align with the cube end attachment apertures 59, shown in FIG. 9 to enable a fastener to be configured therethrough for connecting the edge beam to a corner connector cube. The edge beam also has beam extension attachment apertures 48 configured along the edge beam and a beam wall slot 46 configured between beam extensions of the edge beam. A threaded rivet 47 may be configured in the extension attachment apertures 48 to allow a threaded fastener to screw into the threaded rivet for attachment of stud beams, accessory beams and the like. The edge beam has four beam extensions 43, 43', 43", 43''' configured proximal to the corners of the edge beam, as best shown in FIG. 12. The beam wall slots 46, 46', 46", 46" are configured on respective sides of the edge beam between the beam extensions on that side. This enables the edge beam to be connected in any rotational orientation as it is symmetric is shape.

As shown in FIG. 12, a wall panel 600 is configured with a thickness 623 that enables the wall panel to fit within the edge beam wall slot 46. The edge beam 40 also has a beam center aperture 44. A base center sleeve 45 may extend up into the edge beam 40. The base extensions 27 of a base foot assembly 26, shown in FIG. 25 may extend into a beam center aperture.

Figure 13:
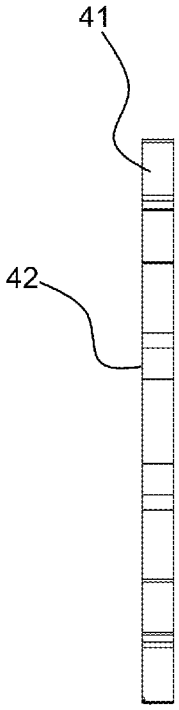
FIG. 13 shows a side cross-sectional view of a beam interconnect panel forming the beam interconnect surface on the beam end of the edge beam.

FIG. 13 shows a side cross-sectional view of a beam interconnect panel 41 forming the beam interconnect surface on the beam end of the edge beam.

Figure 14:
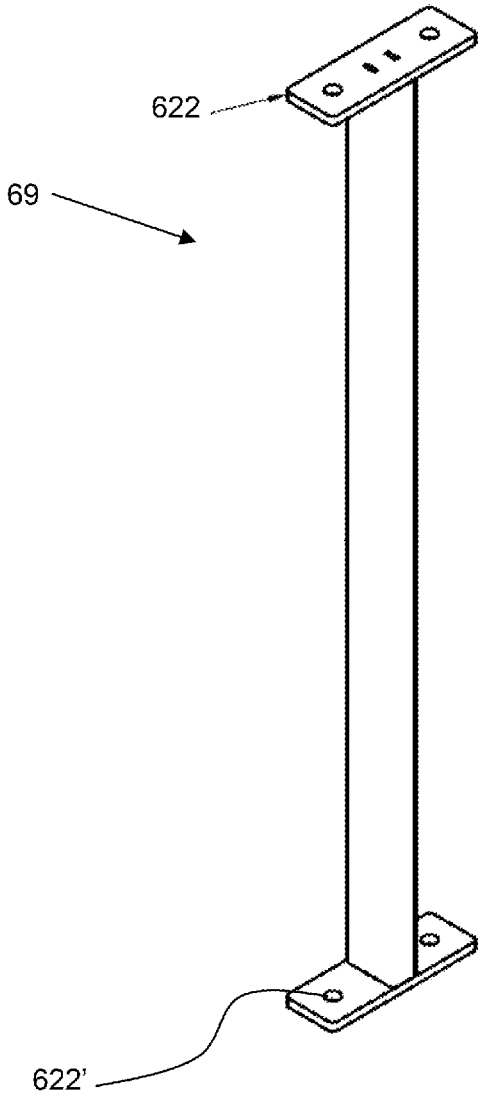
FIG. 14 shows a wall truss beam having a stud beam extension and wall truss beam brackets to connect the stud beam to FIG. 15 shows a perspective view of a base foot assembly having a base extension and a base foot having anchoring holes.

As shown in FIG. 14, a truss beam 69 has a truss extension with truss beam brackets 622, 622' configured on the ends of the stud beam extension. The truss beam brackets have apertures configured to align with beam extension attachment apertures along the edge beam.

Figure 15:
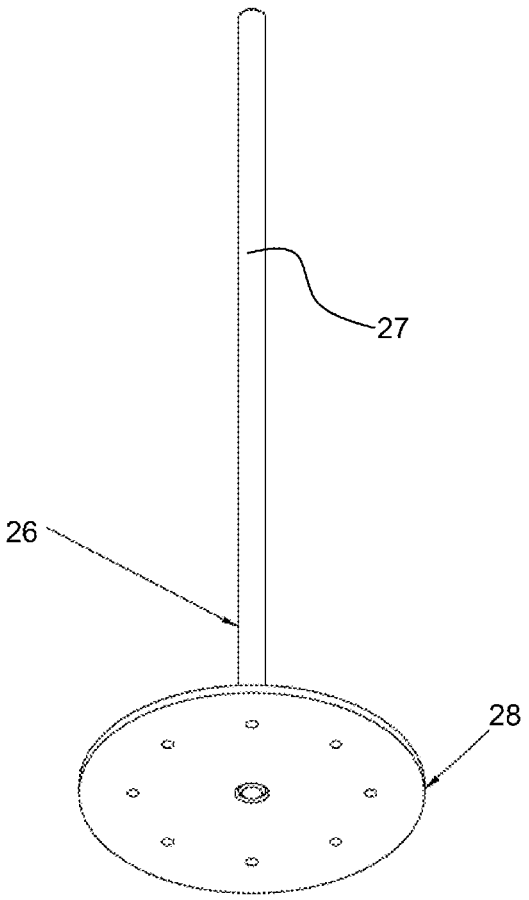
Figure 16:
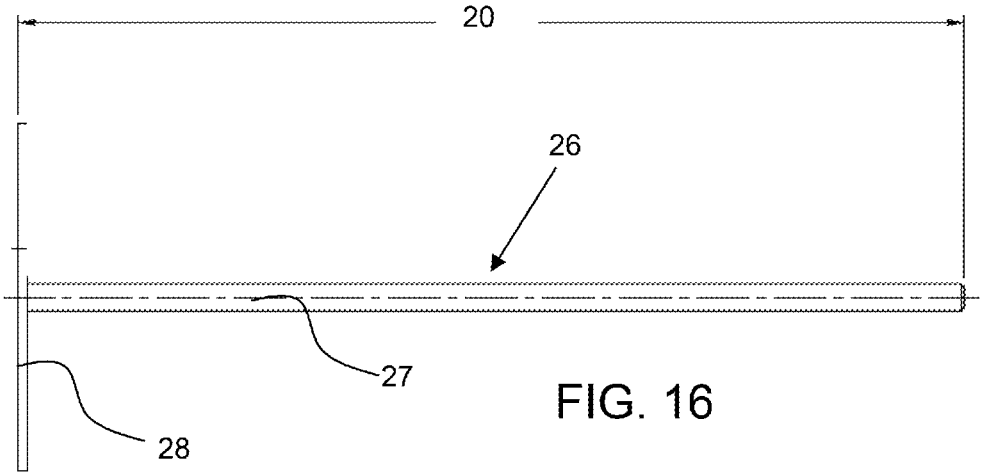
FIG. 16 shows a side view of the exemplary base foot assembly shown in FIG. 15.

Referring to FIGS. 15 and 16, a base foot assembly having a base extension and a base foot 28 connected to a base extension 27 configured to extend into a center aperture of the corner connector cube to retain and secure the base foot assembly to the modular building. The base extension has a length 20 that may be greater than the depth of the cube center sleeve and therefore the base extension may extend up into the beam center aperture, which may have a sleeve as well. This arrangement would further reinforce the edge beam to the corner connector cube. The apertures through the base foot 28 are configured for securing the base foot to a fixed ground support, such as a concrete pad, a footing, a ground anchor and the like.

Figure 17:
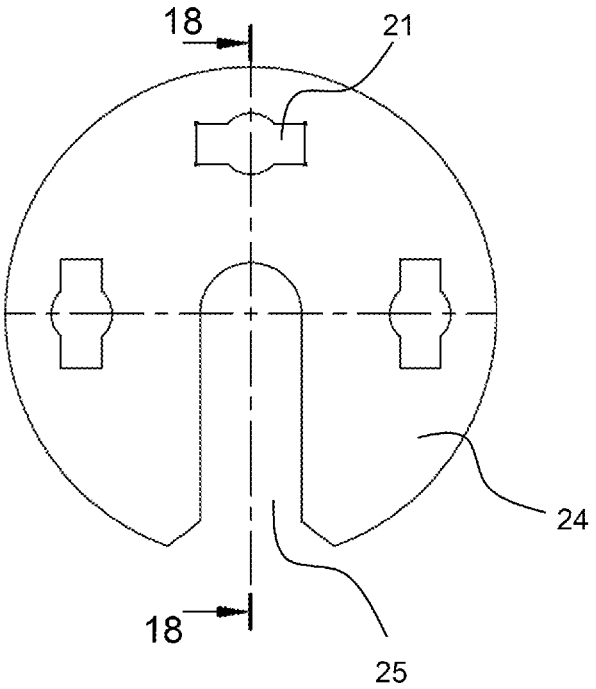
FIG. 17 shows a top view of an exemplary spacer having a space slot configured to receive the base extension of the base foot assembly therein to raise the modular building up from a ground surface.
Figure 18:
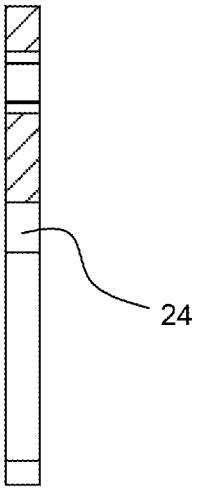
FIG. 18 shows a cross-sectional view of the exemplary spacer shown in FIG. 17.

As shown in FIG. 17, an exemplary spacer 24 has a spacer slot 25 configured to receive the base extension of the base foot assembly therein to raise the modular building up from a ground surface. Any suitable number of spacers may be configured between the base foot and the corner connector cube to level a modular building that is configured on an uneven ground surface or to raise the modular building in the event of flooding or to provide a level walking floor surface from the modular building to another building. The spacer apertures 21 through the spacer are for receiving a retainer, such as a spike or bolt or other fastener to retain the spacer in position and prevent the spacer from rotating or moving.

Figure 19:
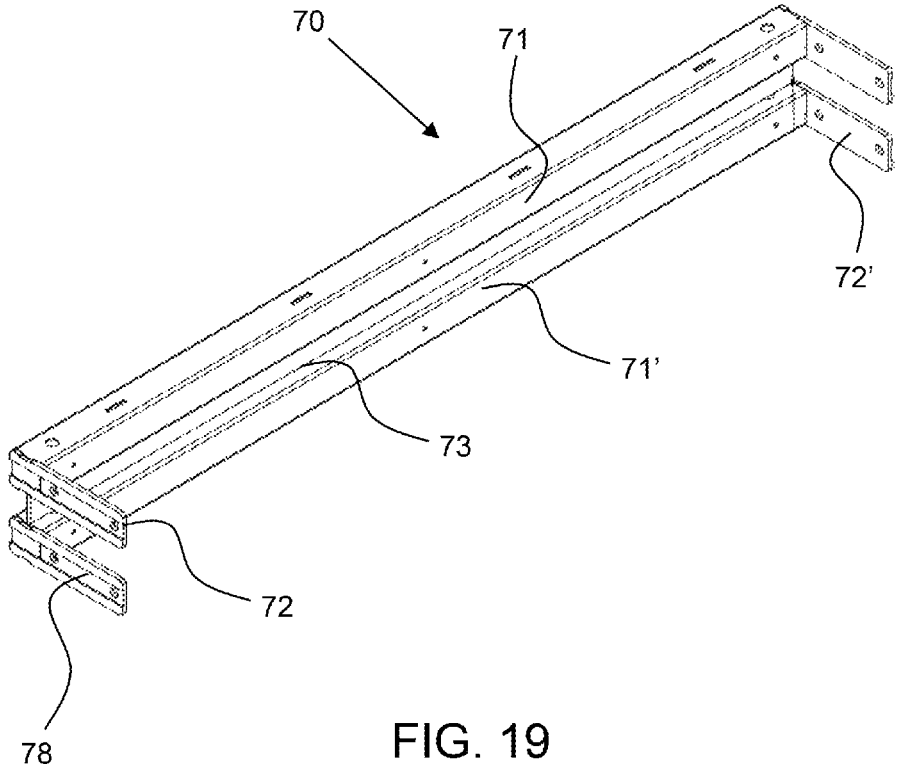
FIG. 19 shows an accessory beam configured to extend between stud beams or an edge beam and a stud beam.

As shown in FIG. 19, an accessory beam 70 is configured to extend between stud beams or an edge beam and a stud beam and has accessory beam attachment brackets 72 on ends of the accessory beam with apertures for receiving a fastener therethrough. Also, this accessory beam has an accessory beam slot 73 between accessory beam extensions 71, 71', that may be configured to receive a window therein, thereby forming a frame for a window with a portion of the window in the accessory beam slot, and other sides of the window in the edge beam slot. An accessory bracket slot 78 is configured in the accessory beam attachment bracket to position the accessory beam for attachment.

Figure 20:
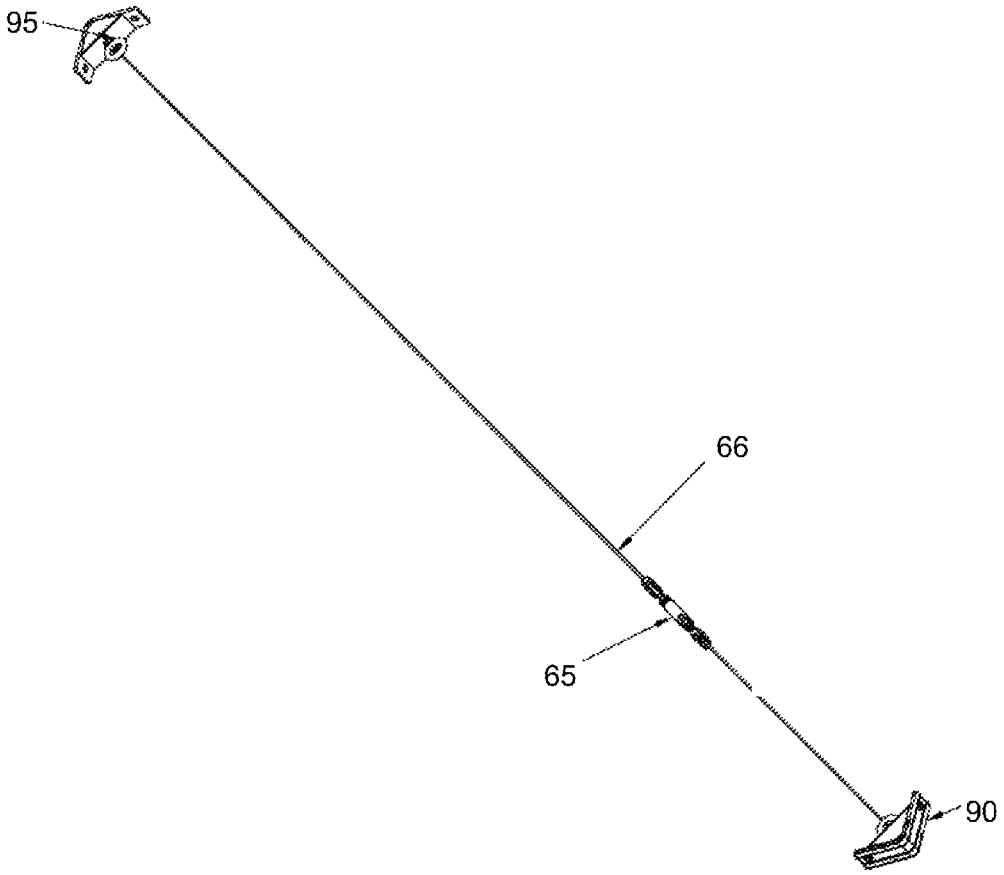
FIG. 20 shows an exemplary cable having support cable end couplers and a support cable tensioner.
Figure 21:
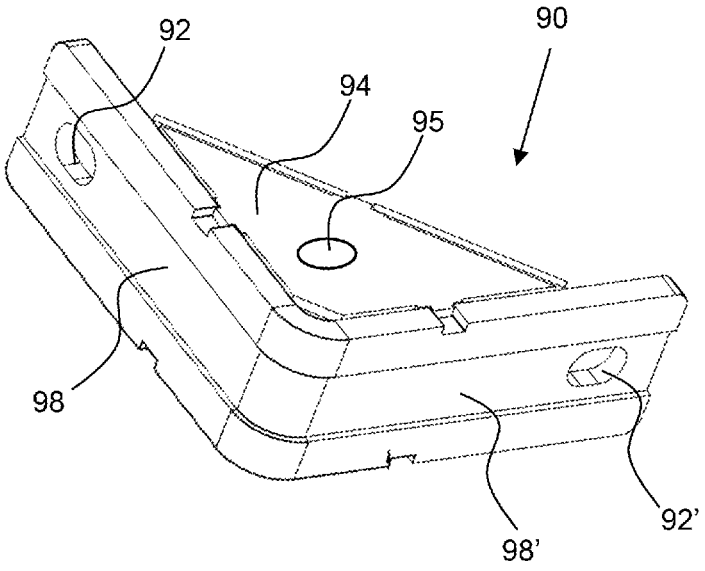
FIG. 21 shows a perspective view of an exemplary support cable end coupler having a bracket for attachment to the modular building frame and an attachment plate with an aperture for coupling to an end of the support cable.

Referring now to FIGS. 20 and 21, an exemplary support cable 66 has support cable attachment brackets 90 and a support cable tensioner 65. The support cable end attachment brackets have bracket apertures 92, 92' in the bracket for connecting the bracket to the modular building, such as to an edge beam. Also, the support cable end attachment brackets have cable bracket slots 98, 98' to allow the end bracket to fit over any threaded rivets or fastener heads that may be extending from the surface of an edge beam or stud. The support cable end attachment bracket also has a cable retainer 94 with a cable receiver aperture 95, therein. A pair of support cables may be configured to extend from the corners of a wall of a modular building to produce an X-brace. The X-brace supports and reinforces the wall, as shown in FIG. 4.

Figure 22:
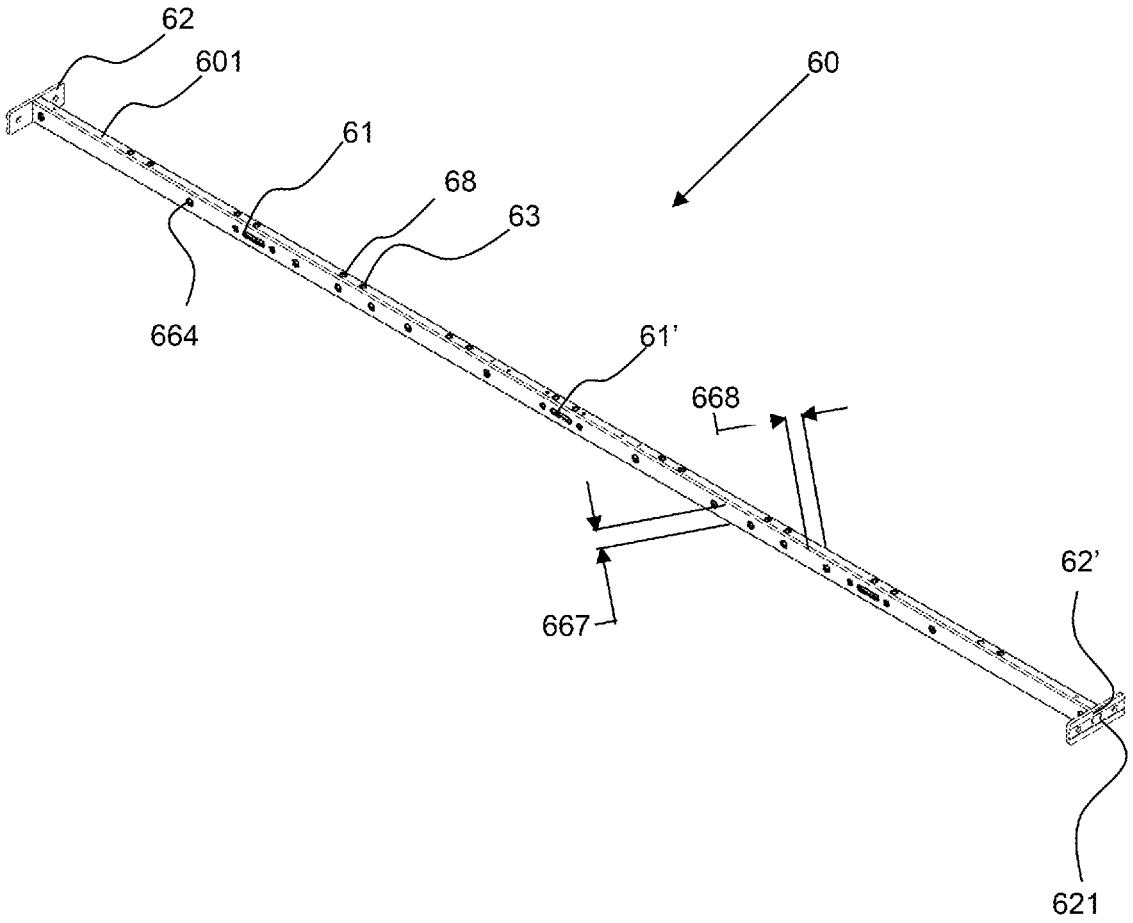
FIG. 22 shows an exemplary stud beam having apertures to receive building material therethrough, such as electrical wires, plumbing and the like FIG. 23 shows a roof accessory extension configured to couple to the modular building and extend out from the walls of the modular building and having a coupler to couple a tarp or other roof materials thereto.

As shown in FIG. 22, an exemplary stud beam 60 has stud attachment brackets 62, 62' on either end of the stud beam extension 601. The stud beam extension has a stud depth 667 that extends into orthogonal to a wall plane and a stud width 668 that extends parallel with a wall plane or side of a modular building. Put another way, the depth extends across an edge beam when the stud beam is coupled with the edge beam by the stud beam attachment brackets. The stud depth 667 of the stud beam extension 601 is greater than the stud width 668 to provide more structural support for a wall, ceiling, or floor panel, or more support for a door or window coupled thereto. The stud depth may be about 25% greater or more than the stud width, or about 50% greater or more, about 100% greater or more, about 200% greater or more and nay range between and including the values provided. Also, the stud beam extension 601 has stud apertures 61, 61' extending through the stud depth surface of the stud beam extension to receive building material therethrough, such as electrical wires, plumbing and the like. The stud beam extension also has stud width extension attachment apertures 68 on the stud width surface of the stud beam extension 601. The stud beam extension also has stud depth extension attachment apertures 664 on the stud depth surface of the stud beam extension 601 for coupling a truss beam or other support, such as an accessory beam, as shown in FIG. 19, for a window or door. A threaded rivet 63 may be configured in any of the stud extension attachment apertures to receive and retain a threaded fastener.

The stud attachment brackets 62, 62' each have a stud attachment bracket slot 621 to allow the stud attachment bracket to slide over threaded rivets on the edge beams or fastener heads extending from the edge beam. The stud attachment bracket slot extends in from one or both ends of the attachment bracket 62.

Figure 23:
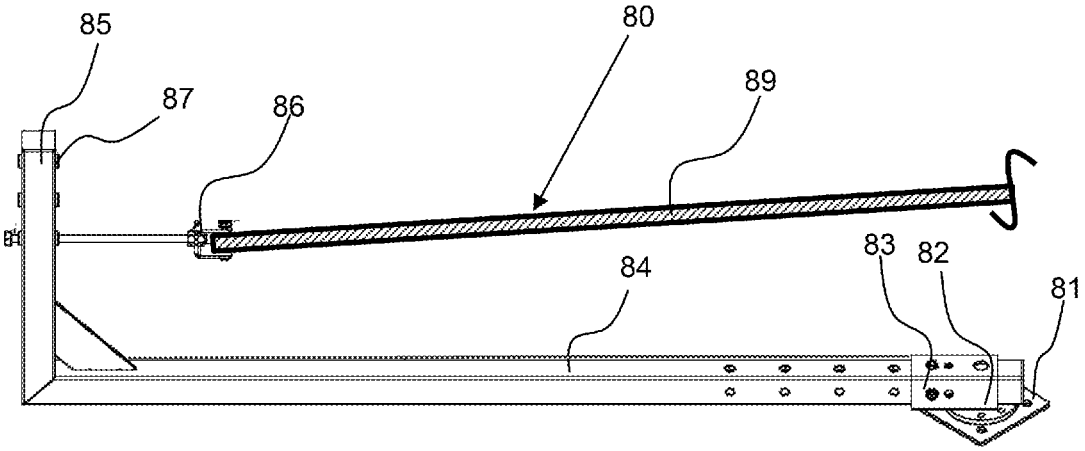

FIG. 23 shows a roof accessory beam assembly 80 configured to couple to a modular building and extend out from the walls of the modular building to support a roofing material, lights, sensor, or any other accessory for the modular building. As shown, the roof accessory beam assembly 80 has roof accessory coupling 82 that is configured to detachably attach to the modular building, such as a corner connector cube. The apertures shown in the roof accessory coupling may be configured to align with the cube end attachment apertures. The roof accessory coupling 82 may be configured such that the roof beam extension 84 extends orthogonally from the wall it is attached to, as shown in FIG. 5, roof accessory beam assembly 80', or at an angle, such as 45 degrees roof accessory beam assemblies 80 and 80". The roof accessory coupling 82 includes a roof coupling plate 81 with apertures for alignment with the cube end attachment apertures and an extension retainer 83 to receive and retain the roof beam extension 84. The roof beam extension 84 may be slid into the extension retainer 83 to adjust the length of the rood beam extension from the wall or modular building. The roof beam extension 84 extends out to an extended end and has a roof beam clamp 86 coupled thereto. The roof beam extension has an orthogonal portion that extends up with a plurality of connection locations for the roof beam clamp to enable various vertical height locations of attachment of a roofing material, for example. A roof cover material 89 is coupled with the roof beam clamp 86 and extends at an offset angle from horizontal to provide drainage of precipitation from the roof cover material. The roof beam clamp 86 is coupled with the roof beam vertical extension 85 having a plurality of clamp attachments 87 configured along the roof beam vertical extension to enable attachment of the roof beam clamp in various vertical positions. A particular low vertical clamp attachment 87 position may be selected on one side of a modular building and a much higher clamp attachment position may be selected on the opposing side of the modular building to create the angle in the roof cover material.

Figure 24:
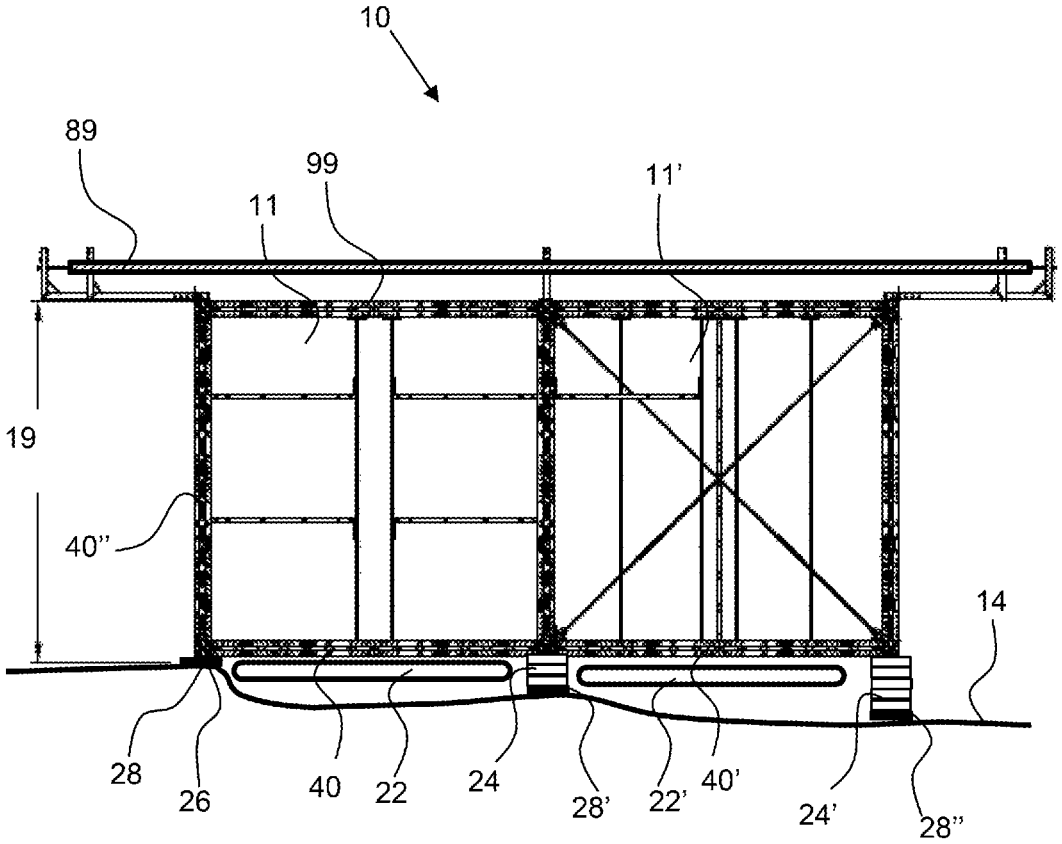
FIG. 24 shows a side view of a modular building erected on an unlevel ground surface with additional spacers configured around the base extensions to extend the base foot to the ground surface and support the modular building.
Figure 25:
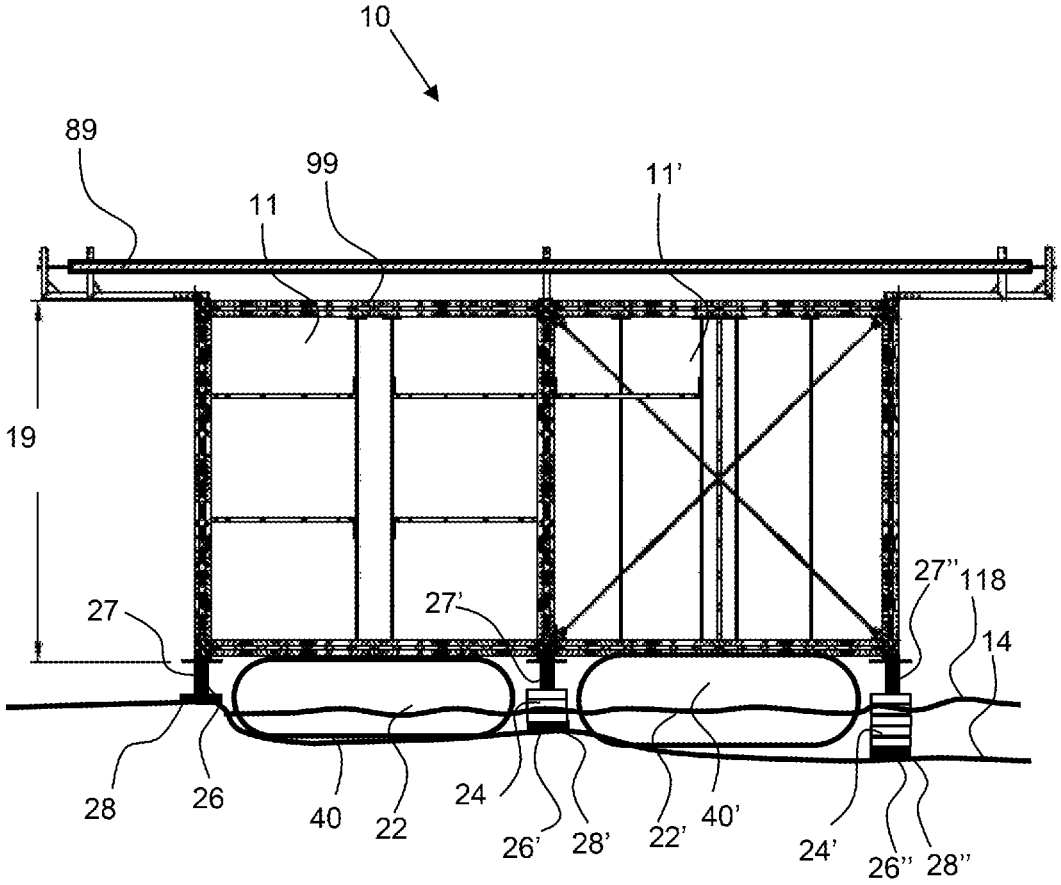
FIG. 25 shows a side view of the modular building shown in FIG. 24, with the water level increased and the bladders inflated to raise the modular building up to prevent flooding.

As shown in FIG. 24, a modular building 10 is erected on an unlevel ground surface with additional spacers 24, 24' configured around the base extensions 27', 27" (as shown in FIG. 25) respectively, to extend the respective base foot 28', 28" to the ground surface and support the modular building. One of the base foot assemblies 26 has a base foot 28 that is directly under the modular building 10, without a spacer. The base foot extension of this base foot assembly extends into the corner connector cube 50 and up into the edge beam 40". The base foot extensions of the other base foot assemblies also extend up through the respective corner connector cube and into the respective edge beams. The base foot extension may be secured to the ground surface 14, such as by fasteners, to prevent the base foot assembly from moving. Also, a pair of bladders 22, 22' are configured under each of the modular bays 11, 11', respectively, to enable the modular building to be raised in the event of flooding. These bladders may be self-inflating, wherein they inflate when the water level reaches a certain level. The bladders must be appropriately sized to the building weight and the building has to be supported by flexible utilities. A roof cover material 89 is coupled to the roof beam clamps and extends over the roof an offset distance 88 from the top of the modular building or roof 99. As discussed herein, the roof cover material may be raised up from the roof 99 to provide additional protection from projectiles.

As shown in FIG. 25, the modular building 10 shown in FIG. 24 is now raised due to the rising water level 118. The bladders 22, 22' have inflated and force the modular building to elevate while be guided by the base foot extensions 27, 27', 27". The spacers 24, 24', 24" are heavier than water and remain proximal to the respective base foot 28, 28', 28" of the respective base foot assemblies 26, 26' 26".

Figure 26:
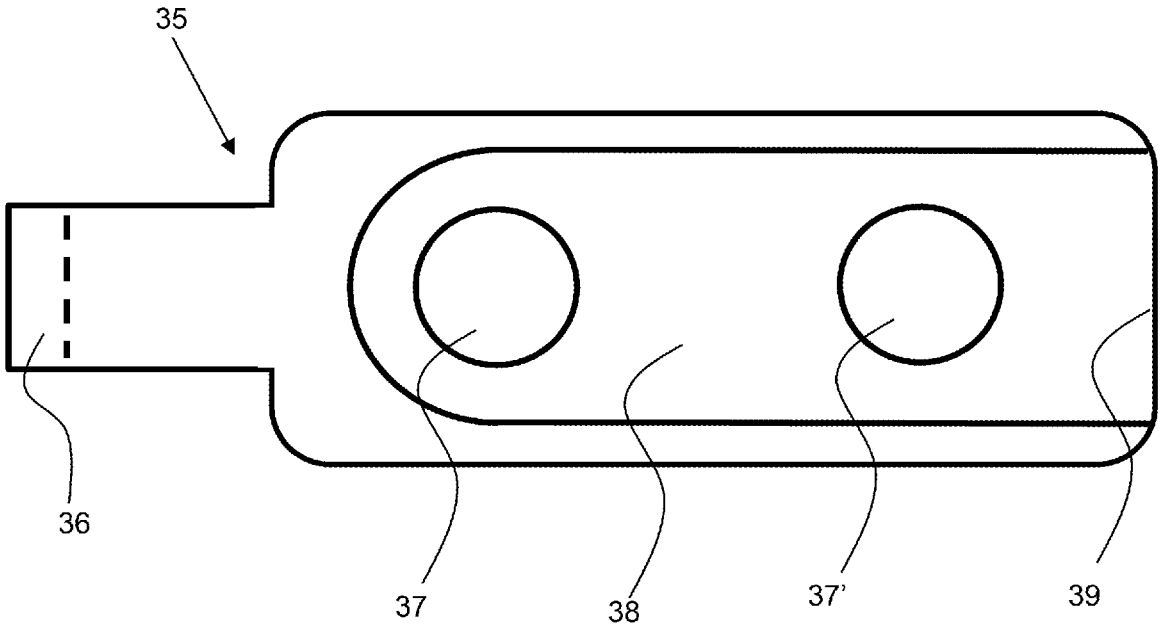
FIG. 26 shows a bottom view of a corner retainer that has apertures for fasteners to retain the corner retainer to an edge beam, such that a corner connector cube is retained by the corner retainer catch to aid in assembly.
Figure 27:
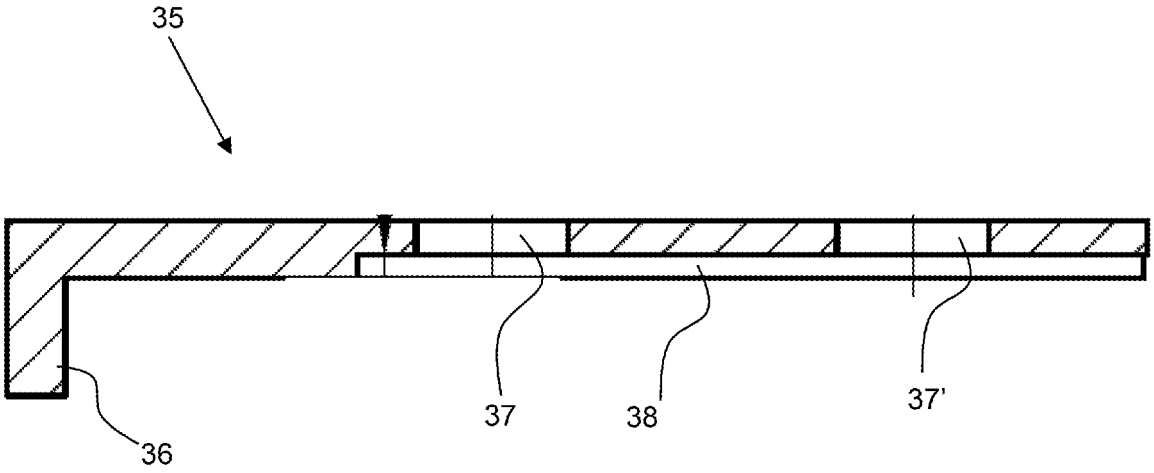
FIG. 27 shows a side view of the corner retainer shown in FIG. 26.
Figure 28:
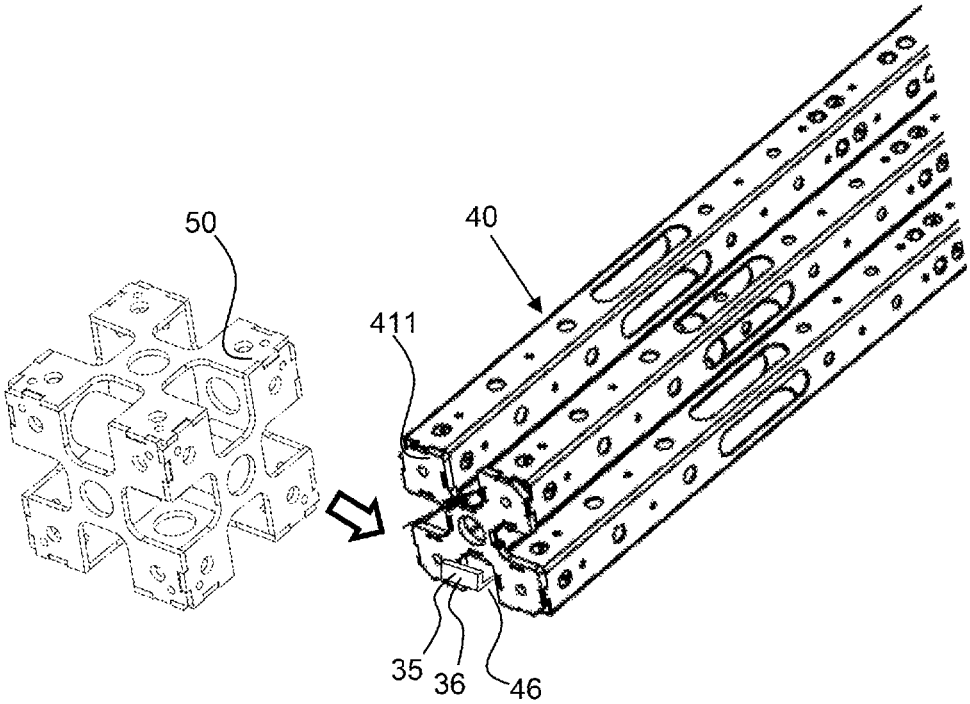
FIG. 28 shows a corner retainer attached to an edge beam with the corner retainer catch extending out from the end of the edge beam to retain the corner connector cube.

Referring now to FIGS. 26 to 28, a corner retainer 35 has apertures 37, 37' for fasteners to retain the corner retainer to an edge beam 40, such that a corner connector cube 50 is retained by the corner retainer catch 36 to aid in assembly. Also, the corner retainer 35 has a corner retainer slot 38 that extends from the attached end 39 of the corner retainer 35 to allow the corner retainer to extend over any fastener heads that may be configured along the edge beam. As shown in FIG. 27, the corner retainer is secure to edge beam within the beam wall slot 46 and the corner catch extends out just the required distance to catch around a wall of the corner catch retainer 50 to secure it in place against the beam end 411 to allow fasteners to be secured between the corner connector cube and the edge beam.

Figure 29:
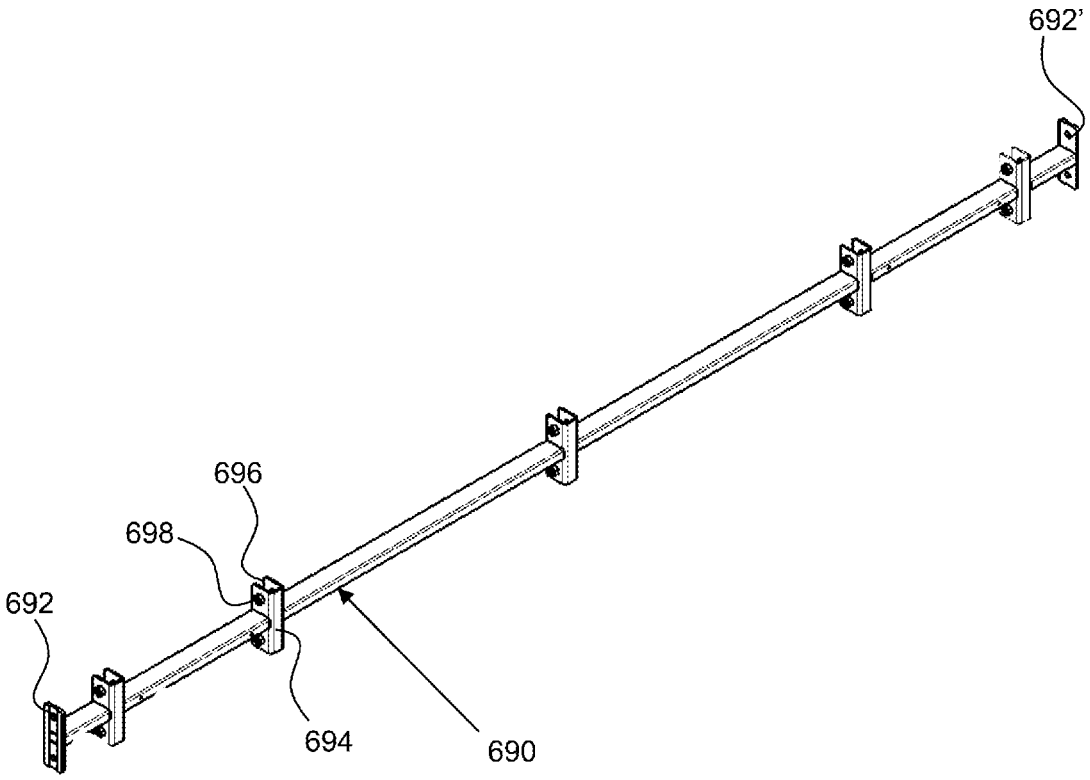
FIG. 29 shows a perspective view of an integral truss beam having a plurality of stud beam receivers positioned between the integral truss beam brackets.

As shown in FIG. 29, an integral truss beam 690 is configured to extend from a first support, such as a first edge beam, to a second support, such as a second edge beam and has integral truss beam brackets 692, 692' for attachment to these supports. The integral truss beam 690 has stud beam receivers 694, each having a stud beam channel 696 to receive a stub beam therein and stub beam retainers 698, such as bolts, that can be turned to secure the stud beam in the stud beam channel. As shown, the integral truss beam has five stud beam receivers between the integral truss beam brackets 692, 692'.

It will be apparent to those skilled in the art that various modifications, combinations and variations can be made in the present invention without departing from the scope of the invention. Specific embodiments, features and elements described herein may be modified, and/or combined in any suitable manner. Thus, it is intended that the present invention cover the modifications, combinations and variations of this invention provided they come within the scope of the appended claims and their equivalents.

What is claimed is:

1. A modular building system configured to erect a modular building, said modular building system comprising:

a) edge beams, each comprising:

i) a length between edge beam ends of at least 2.0 m;

ii) a beam interconnect surface on each of said beam ends comprising beam end attachment apertures;

iii) beam extension attachment apertures configured along the edge beams between the beam ends;

iv) beam wall slots; and v) a beam center aperture on the beam interconnect surface that is configured to align with the center aperture of the corner connector cube;

b) corner connector cubes configured to connect two or more beam ends of two or more edge beams to form a frame for the modular building, said corner connector cube comprising:

i) a symmetric cube shape formed by six cube interconnect panels forming six cube interconnect surfaces that are interchangeable for connection to one of said edge beams;

wherein the six cube interconnect surfaces extend to edges;

ii) cube end attachment apertures configured in each of the six cube interconnect surfaces;

iii) a cube wall slot extending inward from each edge of each of the six interconnect surfaces;

iv) a cube center sleeve extending from a first cube interconnect surface of the six cube interconnect surfaces to a second cube interconnect surface of the six cube interconnect surfaces and opposing said first cube interconnect surface;

wherein at least two opposing cube interconnect surfaces of the six interconnect surfaces further comprise a center aperture that is aligned with the cube center sleeve;

c) stud beams;

d) stud beam attachment brackets configured to connect the stud beams to the edge beams via fasteners extending through the stud beam attachment brackets and into the beam extension attachment apertures of the edge beams;

e) corner fasteners configured to extend from an interior surface of said cube interconnect panel through said cube interconnect panel and into said beam end attachment apertures of said edge beams to connect said edge beams to the corner connector cubes;

f) a base foot assembly comprising:

a base extension; and a base foot coupled to the base extension;

wherein the base extension is configured to extend into the cube center aperture to form a base for the modular building;

wherein the base extension extends through the center apertures of the corner connector cube, through the cube center sleeve and into the beam center aperture when said modular building system is erected; and g) spacers each having a spacer slot configured to receive the base extension therein to produce a space between the corner connector cube and the base foot;

wherein a height of an edge beam and a floor of the modular building is configured to be raised from a ground surface by the addition of additional spacer between the corner connector cube and the base foot; and wherein the modular building is configured to be erected by attachment of edge beams to the corner connector cubes and with wall panels configured in the beam wall slots of the edge beams.

2. The modular building system of claim 1, wherein the six cube interconnect surfaces and the beam interconnect surfaces are planar surfaces.

3. The modular building system of claim 1, wherein each of the beam interconnect surfaces of the edge beam comprises four end attachment apertures, and wherein the cube interconnect surfaces of the corner connector cube have four cube end attachment apertures configured to align with the said four beam end attachment apertures of the interconnect surface of the edge beam to receive a fastener therethrough.

4. The modular building system of claim 1, wherein the beam interconnect surface of the edge beam is an edge panel.

5. The modular building system of claim 1, wherein the corner connector cubes comprise a cube wall slot extending inward toward a center of the cube interconnect surface from each of the sides from each of the edges, wherein each cube interconnect surface of corner connector cube has four cube wall slots.

6. The modular building system of claim 5, wherein said wall panel is configured to extend into one of said cube wall slots of the cube interconnect surface of the corner connector cube.

7. The modular building system of claim 6, wherein each of the four cube end attachment apertures are configured proximal to corners of the cube interconnect surface and wherein one of said slots of the corner connector cube is configured between each of the four end attachment apertures.

8. The modular building system of claim 1, wherein each of the six cube interconnect surfaces of the corner connector cube comprises four cube end attachment apertures.

9. The modular building system of claim 1, wherein the stud beams have a stud width and a stud depth that extends across an edge beam when the modular building is erected and wherein the stud depth is at least 25% greater than the stud width.

10. The modular building system of claim 1, wherein the stud beams further comprise stud beam apertures configured for a support cable to extend therethrough.

11. The modular building system of claim 10, wherein the stud beams further comprise stud width extension attachment apertures.

12. The modular building system of claim 11, wherein the stud beams further comprise stud depth extension attachment apertures.

13. The modular building system of claim 1, wherein the stud beams further comprise stud width extension attachment apertures.

14. The modular building system of claim 13, wherein the stud beams further comprise stud depth extension attachment apertures.

15. The modular building system of claim 13, further comprising a corner retainer comprising a corner retainer extension and corner retainer catch extending from an end of the corner retainer extension wherein the corner retainer is configured for attachment to an edge beam with the corner retainer extension extending out from the beam interconnect surface to support a corner connector cube by the corner retainer catch for assembly.

16. The modular building system of claim 1, further comprising a roof accessory beam assemblies that are coupled to corner connector cubes and have a roof beam extension that extends out from an outer perimeter of walls of the modular building.

17. The modular building system of claim 16, wherein the roof accessory beam assemblies have a roof accessory coupling configured to detachably attach to a corner connector cube.

18. A modular building system configured to erect a modular building, said modular building system comprising:

a) edge beams, each comprising:

i) a length between edge beam ends of at least 2.0 m;

ii) a beam interconnect surface on each of said beam ends comprising beam end attachment apertures;

iii) beam extension attachment apertures configured along the edge beams between the beam ends; and iv) beam wall slots;

b) corner connector cubes configured to connect two or more beam ends of two or more edge beams to form a frame for the modular building, said corner connector cube comprising:

i) a symmetric cube shape formed by six cube interconnect panels forming six cube interconnect surfaces that are interchangeable for connection to one of said edge beams;

wherein the six cube interconnect surfaces extend to edges;

ii) cube end attachment apertures configured in each of the six cube interconnect surfaces;

iii) a cube wall slot extending inward from each edge of each of the six interconnect surfaces;

c) stud beams;

d) stud beam attachment brackets configured to connect the stud beams to the edge beams via fasteners extending through the stud beam attachment brackets and into the beam extension attachment apertures of the edge beams;

e) corner fasteners configured to extend from an interior surface of said cube interconnect panel through said cube interconnect panel and into said beam end attachment apertures of said edge beams to connect said edge beams to the corner connector cubes:

wherein the modular building is configured to be erected by attachment of edge beams to the corner connector cubes and with wall panels configured in the beam wall slots of the edge beams f) a roof accessory beam assemblies that are coupled to corner connector cubes and have a roof beam extension that extends out from an outer perimeter of walls of the modular building:

wherein the roof accessory beam assemblies have a roof accessory coupling configured to detachably attach to a corner connector cube; and wherein the roof accessory coupling has a roof coupling plate with apertures configured to align with cube end attachment apertures of the corner connector cube to receive a fastener therethrough to attach the roof accessory coupling to the corner connector cube.

19. The modular building system of claim 18, wherein the roof coupling plate is configured to couple with the cube end attachment apertures of the corner connector cube to extend the roof beam extension orthogonally or at an offset angle from the corner connector cube.

20. The modular building system of claim 18, wherein the roof accessory coupling has an extension retainer and wherein the roof beam extension is secured to the extension retainer.

21. The modular building system of claim 20, wherein the roof beam extension is slidably engaged with the extension retainer.

22. The modular building system of claim 1, further comprising a truss beam configured between stud beams to provide additional support.

23. The modular building system of claim 22, wherein the truss beam is an integral truss beam having a plurality of stud beam receivers comprising a stud beam channel for receiving one of said stud beams therein.

24. The modular building system of claim 23, wherein the integral truss beam further comprises a stud beam retainer that secures the stud beam within the stud beam channel.

25. The modular building system of claim 24, wherein the stud beam retainer is a bolt that extends into the stud beam channel.

* * * * *